US005782417A

United States Patent [19]

Niederholtmeyer

[11] Patent Number: 5,782,417

[45] Date of Patent: Jul. 21, 1998

[54] TIRE SHREDDER

[76] Inventor: Werner Niederholtmeyer, 7804 Fritz Rd., Fort Wayne, Ind. 46818

[21] Appl. No.: 738,027

[22] Filed: Oct. 25, 1996

[51] Int. Cl.[6] ..... B02C 19/12

[52] U.S. Cl. ..... 241/277; 241/283; 241/DIG. 31

[58] Field of Search ..... 241/283, 204, 241/205, DIG. 31, 34, 60, 277, 280

[56] References Cited

U.S. PATENT DOCUMENTS

| | | | |
|---|---|---|---|
| 1,372,001 | 3/1921 | Antoine | 241/205 |
| 4,015,782 | 4/1977 | Granite | 241/DIG. 31 |
| 4,223,845 | 9/1980 | Selonke et al. | 241/280 |
| 4,509,700 | 4/1985 | Svengren | 241/283 |
| 4,796,821 | 1/1989 | Pad et al. | 241/283 |

*Primary Examiner*—Mark Rosenbaum
*Attorney, Agent, or Firm*—O'Malley and Firestone

[57] ABSTRACT

The tire shredder has a frame supporting two parallel, vertically spaced rails on which are mounted a wheeled carriage. A variable speed, bi-directional motor provides reciprocating movement of the wheeled carriage on the tracks. The wheeled carriage supports a cutting assembly which includes a drive motor, a shaft and a plurality of circular saws mounted on the shaft for rotation with the shaft. The shaft is mounted with its axis of rotation parallel to the direction of movement of the carriage. Tires are fed to the circular saws by a conveyer system. A bottom conveyer carries the tires substantially parallel to the floor. A top conveyor, is positioned above the first conveyer, slanting downwardly toward the bottom conveyor from the opening for the tires to the discharge point adjacent the saws. Both conveyers are driven by a variable speed motor.

18 Claims, 9 Drawing Sheets

TIRE SHREDDER

BACKGROUND OF THE INVENTION

The present invention relates to an apparatus for shredding automobile tires and more particularly to providing a compact and inexpensive tire shredder.

Used tires present many difficulties for recycling despite the many uses that can be made of the basic materials in the tires. For most uses, whole tires are not acceptable and the tires must be reduced to particles, or powder, for use. Generally, the finer the particles into which the tire is cut the more possibilities there are for recycling. Tires are, of course, made to be highly durable, particularly with respect to resisting cutting, which has forced recyclers to use large, expensive, heavy duty machinery to reduce used tires to small particles.

Large, heavy duty machinery is expensive and is efficiently used by only those who have a large, steady supply of used tires. The primary source of used tires is automobiles, and, more particularly, the tire stores where drivers have their autos maintained. Many such stores are not large enough to efficiently use the kind of heavy duty machinery required to reduce tires to powder. Thus, many stores store used tires until collecting enough to ship to a centralized recycling facility.

Tires are bulky relative to weight, which makes the storage of used tires inside difficult because of the large space required. The outdoor storage of used tires, while done, is known to pose health risks as water collects inside the tires providing a breeding ground for mosquitos. Storing used tires adds to the dangers posed by fire because tires can serve as a fuel source and because they produce heavy smoke when burning. The same bulkiness which makes tires inefficient to store also makes them relatively expensive to ship. A truck fully loaded with tires travels at far below its weight capacity.

The recycling of tires would be eased if they could be reduced at the source, since converting the tires to particles aids not only recycling, but also reduces the space requirements for shipping and storing.

Some inventors have tried to deal with this problem by making tire shredding equipment transportable. For example, U.S. Pat. Nos. 5,375,775 to Keller, et al. 4,374,573 to Rouse et al., 4,180,004 to Johnson, and 3,913,850 to Daniel are all directed to transportable machines providing the fine reduction of tires for recycling. After use both the machinery and the debris must be removed. The proposals do not address the storage problem of small and medium sized shops.

SUMMARY OF THE INVENTION

It is an object of the invention to provide a simple, low cost apparatus for reducing tires, particularly automobile tires to a particulate size convenient for recycling storage and shipping.

It is a further object of the invention to provide a tire shredder constructed from common parts for ease of maintenance.

It is a still further object of the invention to provide a compact tire shredder.

The invention provides an apparatus for shredding tires. The tire shredder includes a frame adapted to rest on a floor. The frame supports two parallel, vertically spaced rails on which are mounted a wheeled carriage. A variable speed, bi-directional motor provides reciprocating movement of the wheeled carriage parallel to the floor with the travel of the carriage limited by opposed relays which are thrown by movement of the carriage. The wheeled carriage supports a cutting assembly which includes a drive motor, a drive shaft and a plurality of circular saws mounted on the drive shaft for rotation with the shaft. The shaft is mounted with its axis of rotation parallel to the direction of movement of the carriage. The circular saws may be canted with respect to the axis of rotation of the drive shaft. The tracks may be opened at one end allowing the wheeled carriage to be removed from the tracks for maintenance.

Tires are fed to the circular saws by a conveyer system. Bottom and top conveyers are constructed from T-bars set across parallel chains for gripping and urging tires into the saws. The bottom conveyer carries the tires substantially parallel to the floor. The top conveyor, substantially identical to the first, is positioned directly above the first conveyer, slanting downwardly toward the bottom conveyor from the opening for the tires to the discharge point adjacent the saws. The downward slope serves to compress the tires as they move toward the saws. The conveyers are driven by a variable speed motor. Yet another conveyer belt may be provided on to which tires may be thrown and carried into the cooperating top and bottom conveyers which feed the saws.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
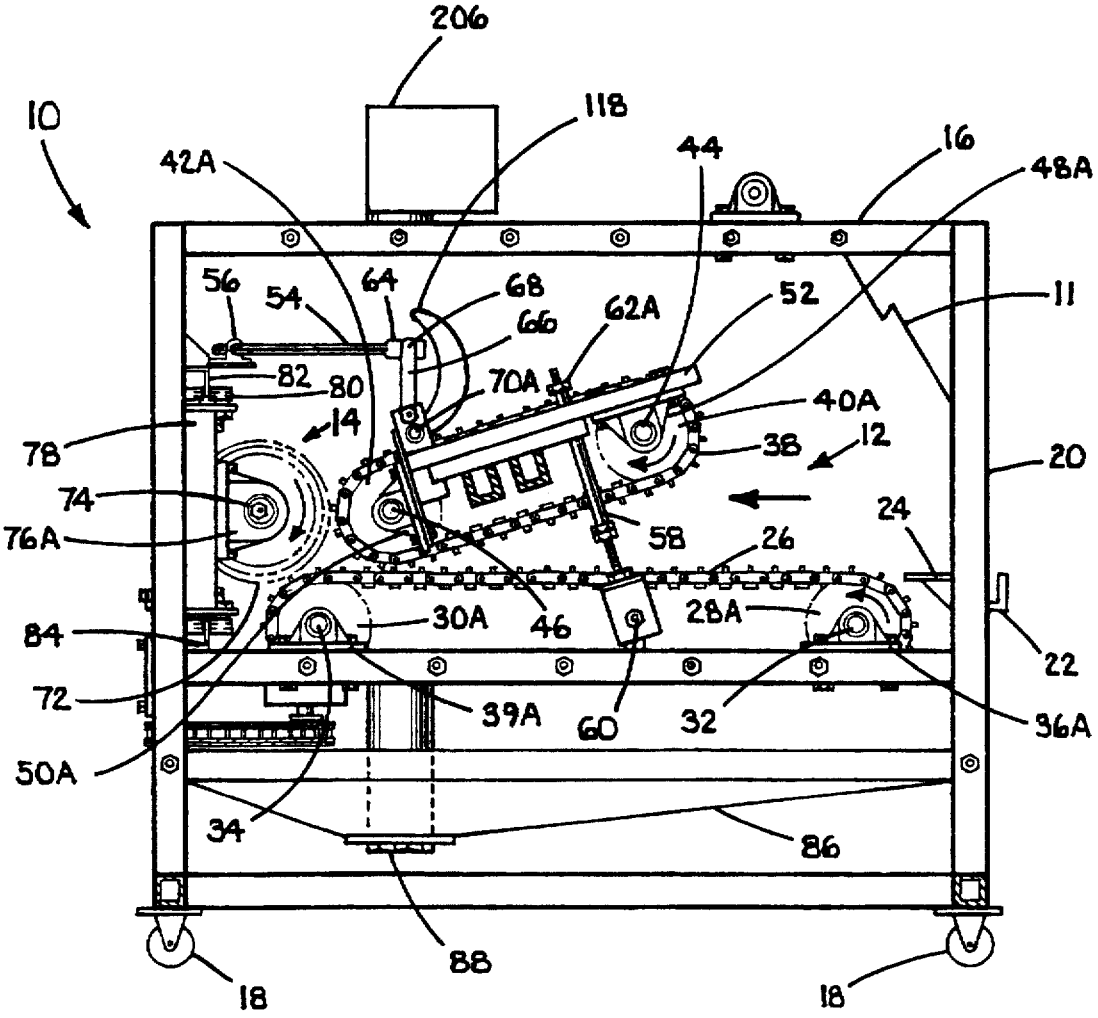
FIG. 1 is a side cutaway view of the tire shredder in accordance with the invention.

Referring now to the Figures wherein like numbers refer to similar parts and particularly FIG. 1, a tire shredder 10 is illustrated. Tire shredder 10 is a compact machine measuring fewer than two meters in any dimension, height, width or depth. Tire shredder 10 reduces worn automobile tires to shreds by transporting and compressing tires through a conveyor system 12 and then shredding the compressed tires in a rotary cutting assembly 14 set across the discharge end of the conveyor system. The assembly of the conveyor system 12 and the rotary cutting assembly 14 are held on a compact box frame 16. Box frame 16 may be mounted on wheels 18 placed at each of four corners to allow easy repositioning of tire shredder 10 on a floor. In use a cover 11 shields the interior assembly.

The feed direction of tires into and through conveyor system 12 is indicated by an arrow pointing from right to left in FIG. 1. Tires are introduced to conveyor system 12 through a side 20 of frame 16 adjacent a ledge hook 22. Tires are placed on to a shelf 24 and a bottom or support conveyor 26, or onto an external feed conveyor or support mounted to ledge hook 22. Ledge hook 22 is bolted to frame 16 for ease of removal if no external feed arrangements are to be used. Support conveyor 26 is one of two conveyors and is trained between sprockets 28A and 30A, which are mounted on shafts 32 and 34, respectively. Shafts 32 and 34 are mounted for rotation in bearing packs 36 and 38, respectively, and shaft 32 is driven in the counterclockwise direction drive conveyor 26 in the direction of the arrow and to urge tires into engagement with an upper or compression conveyor 38. A motor drives support conveyor 26 through shaft 32 and sprocket 28A.

Rotary cutting assembly 14 is aided by flattening tires as they are fed into the assembly. The overhead compression conveyor 38 is set at an angle relative to support conveyor 26 to provide minimum spacing between conveyors 26 and 38 at the point of discharge of tires from conveyor system 12 and thereby progressively flattening the tires as they move through conveyor system 12. The angle is selected to provide sufficient spacing between conveyors 26 and 38 at the input end to allow conventional automobile tires to be engaged by both conveyors before flattening begins. Conveyor 38 is trained between sprockets 40A and 42A, and 40B and 42B, respectively. Sprockets 40A and 40B are mounted on shaft 44 and sprockets 42A and 42B are mounted on shaft 46. Shaft 44 is driven in the clockwise direction as viewed in FIG. 1, so that conveyor 38 cooperates with conveyor 26 in urging tires toward rotary cutting assembly 14. The same motor may be used to drive conveyors 26 and 38.

Conveyors 26 and 38 require substantial longitudinal and latitudinal rigidity to compress tires without deforming themselves. The position of support conveyor 26 is fixed relative to frame 16 since bearing blocks 36A, 36B and 39A and 39B for shafts 32 and 34, respectively, are mounted directly to frame 16.

Conveyor system 12, while implemented for automobile tires, handles tires in a variety of sizes. Compression conveyor 38 is mounted on a subframe 52, which provides attachment points for supporting the subframe from frame 16. The positioning of subframe 52 is spring biased to allow tire shredder 10 to handle tires of differing sizes. Specifically, subframe 52 provides for support at four points spaced along the sides of the subframe. Support at two points along opposite edges of subframe 52 is provided by attachment of the subframe to opposite ends of a stabilizer bar 54. Stabilizer bar is supported from frame 16 at an attachment point 56. Stabilizer bar 54 can bend to allow some variation in the minimum spacing between support conveyor 26 and compression conveyor 38 while keeping the spacing even from side to side. Stabilizer bar 54 includes three parts, a torsion bar 64 and two pivoting plastic connecting ties 66A and 66B. Torsion bar 64 is connected to connecting ties 66A and 66B (not shown) at pivots 68, and the ties connect to subframe 52 at pivots 70. The gap between support conveyor 26 and compression conveyor 38 at the input end requires little allowance for movement to accommodate differing tire sizes. Opposite sides of subframe 52 are supported by pivoting support rods 58A and 58B. The pivot points 60A and 60B (not shown) for rods 58A and 58B are set below the working face of conveyor 26 on a leg of frame 16. Rods 58A and 58B may be spring loaded between retaining nuts 62A and 62B (not shown) and subframe 52.

Compression conveyor 38 is trained on four sprockets, including sprockets 40A and 42A. Sprockets 40A and 42A are mounted on shafts 44 and 46, respectively, which are in turn mounted for rotation in bearing blocks 48A and B and 50A and B, respectively. Bearing blocks 48A and B and 50A and B are attached to a rigid subframe 52 to fix the position of conveyor 38 on subframe 52.

Tires, as they emerge from between conveyors 26 and 38, are fed directly into rotary cutting assembly 14. Rotary cutting assembly 14 reciprocates across the discharge end of conveyor system 12. Rotary cutting assembly 14 includes a plurality of circular saws 72 mounted on a shaft 74, which is mounted for rotation on bearing blocks 76A and B. Shaft 74 rotates in a clockwise direction as viewed from the perspective of FIG. 1, and accordingly circular saws 72 tear material from tires downwardly. Bearing blocks 76A and 76B are mounted on a carriage 78 which is carried by wheels 80 along tracks 82 and 84. Tracks 82 and 84 are arranged parallel to one another and the floor with track 82 being directly over track 84. Carriage 78 has a travel on tracks 82 and 84 parallel to the floor and perpendicular to the feed path through conveyor system 12. Shaft 74 is mounted on carriage 78 with its axis of rotation parallel to the travel of the carriage.

Shredded material is collected for disposition in a chute 86, which is open at the bottom to allow attachment of a collection bag or hose. Extending from opening 87 at the bottom of chute 86 is an outlet for pipe 88 from blower 206. The air stream ejected from pipe 88 is intended to entrain small particulate material in a fluid stream for removal.

Figure 2:
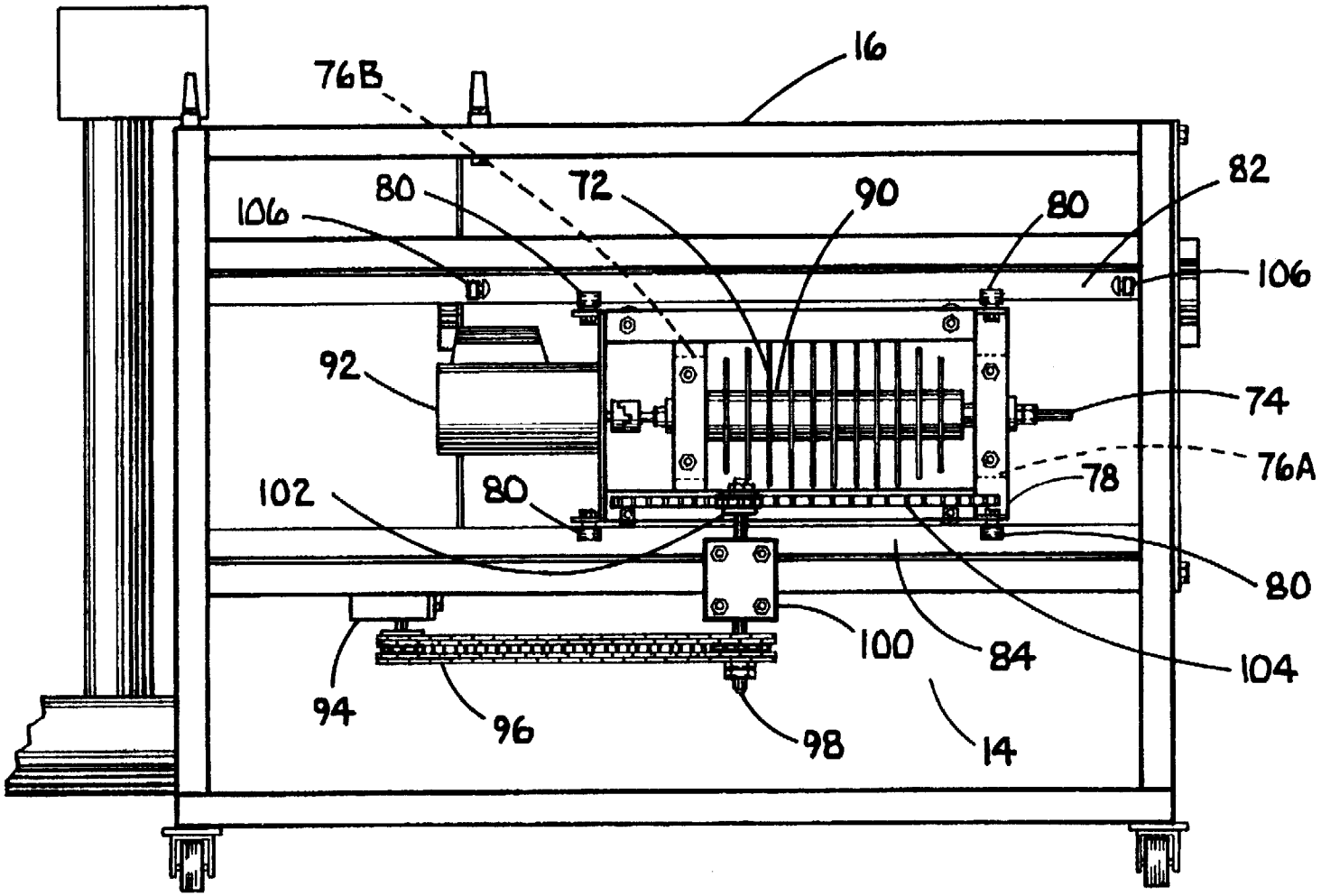
FIG. 2 is a rear cutaway view of the tire shredder.

Referring now to FIG. 2, rotary cutting assembly 14 is shown in greater detail, illustrating the plurality of circular saws 72 as spaced by a plurality of spacers 90 set between the saws. Circular saws 72 are illustrated as perpendicular to shaft 74 and held in a even spaced relationship one to the next. The outside saws are of slightly reduced diameter vis-a-vis the interior saws. An alternating current electric motor is mounted on carriage 78 and is directly coupled to drive shaft 74.

Reciprocation of carriage 78 on tracks 82 and 84 provides more complete shredding of tires than would be achieved by a stationary support assembly for the circular saws. Canting circular saws 72 on shaft 74 provides cutting of the tires at a variety of angles. The total effect is that the points of contact between blades and tire are closely spaced. A reversible drive motor moves carriage 78 on a rack and pinion drive system. Power is coupled from motor and gear box assembly 94 to a chain 96, which in turn drives a shaft 98 mounted for rotation in a bearing block 100 mounted on frame 16. A pinion 102 is set on one end of shaft 98 to engage a rack 104, which is attached to carriage 78. Motor and gear box assembly 94 changes direction when wheels 80 collide with motor reversing relays 106 attached to opposite ends of rail 82. Thus carriage 78 reciprocates on a travel defined by rails 82 and 84.

Figure 3:
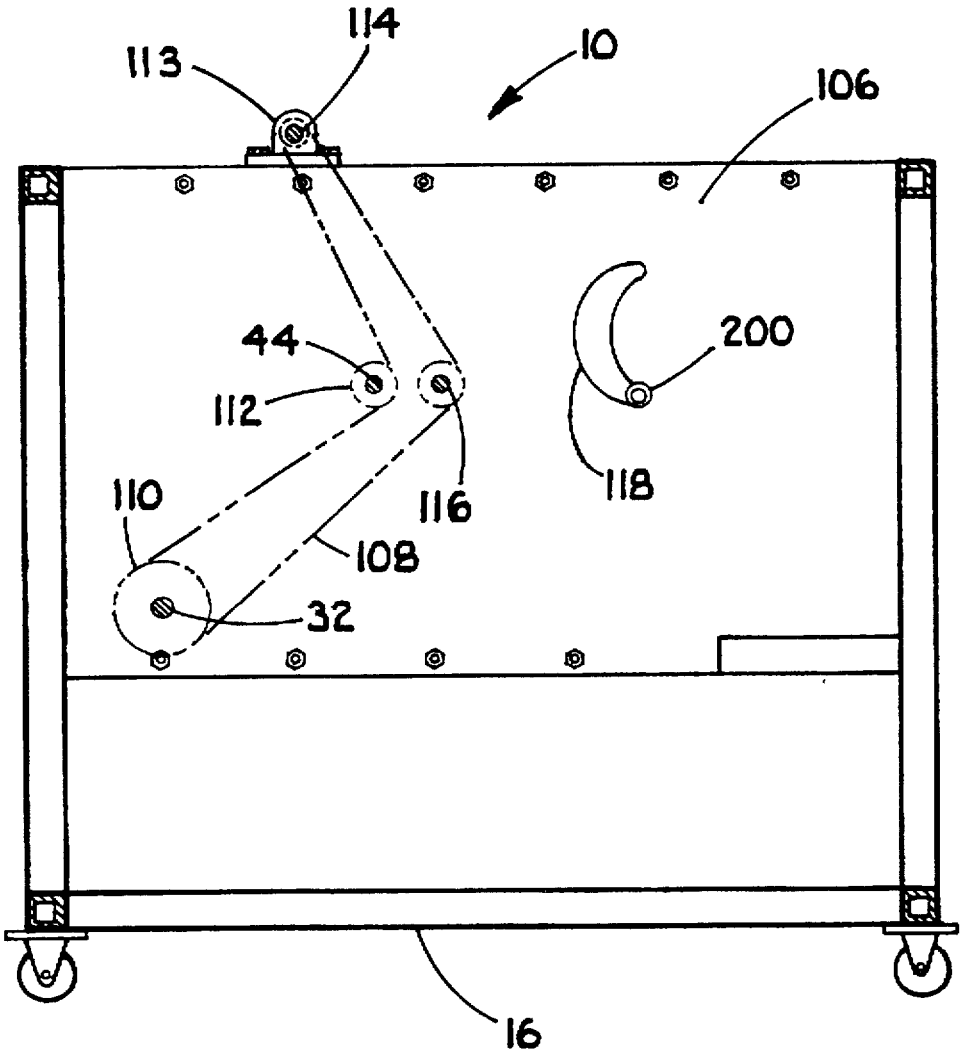
FIG. 3 is a side elevational view.

FIG. 3 depicts a portion of the drive train for compression conveyor 38. A sprocket 110 is attached to one end of shaft 32, which is in turn driven by a variable speed motor. A drive belt or chain 108 is trained between sprocket 110 and sprocket 112, which is connected to shaft 44 of compression conveyor 38. A bearing block 113 supports a return sprocket 114, which is positioned on frame 16 to provide a good catch for drive chain 108 on sprocket 112. Drive chain 108 is returned to sprocket 110 by an idler sprocket 116. Cover 106 has a slot 118 through which a pivot guide 200 for pivot 70B projects. Similarly a pivot guide is provided through a slot in cover 11 for pivot 70A. Pivot guides 200 maintain spacing between compression conveyor 38 and rotary cutting assembly 14 as tires are discharged from between conveyor 38 and support conveyor 26 and conveyor 38 rises. Slot 118 is a semicircle with a diameter equal to the diameter of the largest diameter saw 72 in rotary cutting assembly 14.

Figure 4:
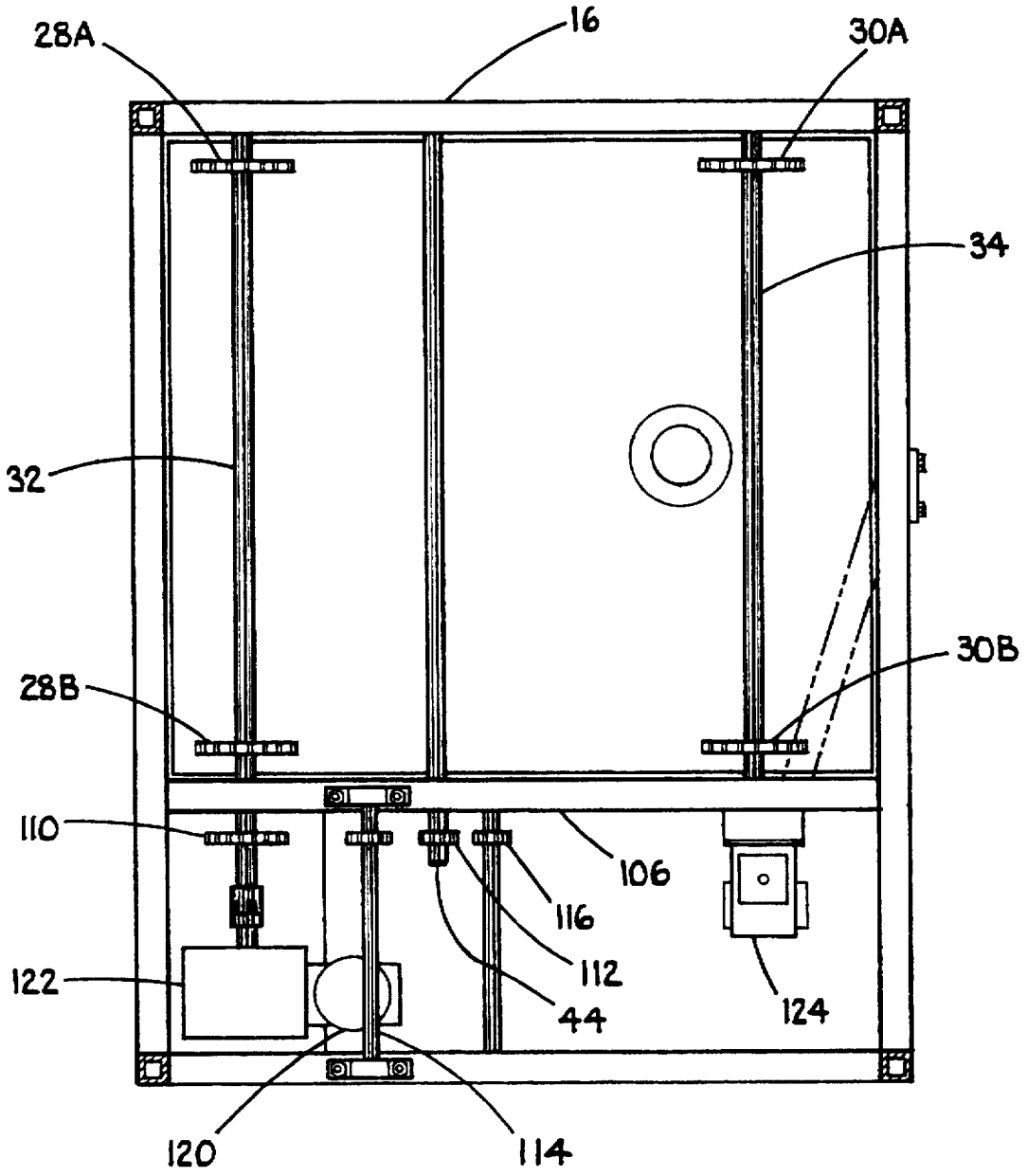
FIG. 4 is a cross-sectional view of the tire shredder.

FIG. 4 depicts the support assembly and the remainder of the drive train for support conveyor 26. Support conveyor is supported between shafts 32 and 34 on sprockets 28A, 28B, 30A and 30B. Shaft 32 is directly coupled by coupler 122 to a variable speed drive motor 120, which also powers compression conveyor 38 described above.

Figure 5:
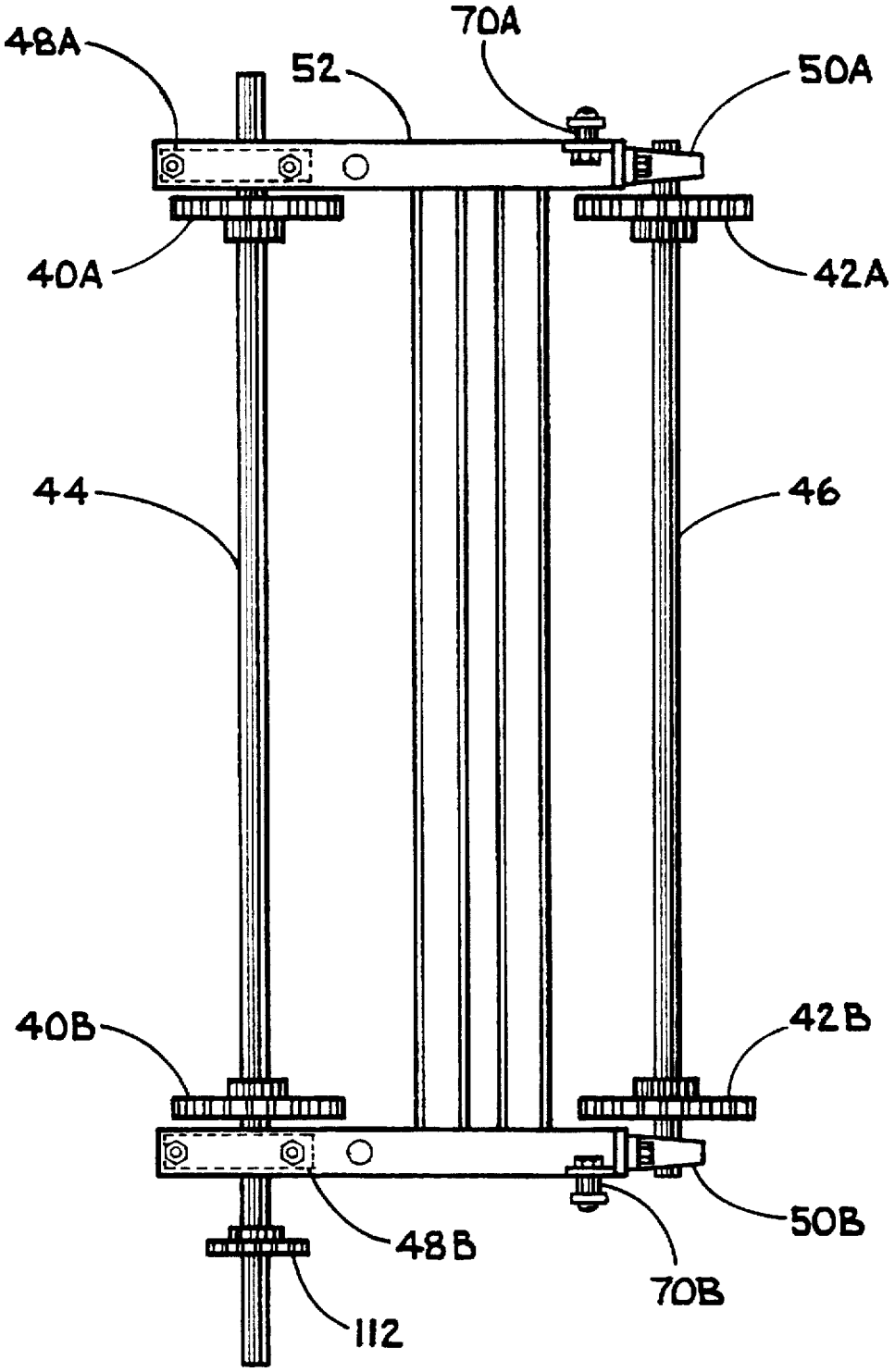
FIG. 5 is a top view of a compression conveyor subframe.

FIG. 5 illustrates subframe 52 and the drive train for compression conveyor 38 in greater detail. Compression conveyor 38 is supported between shafts 44 and 46 on sprockets 40A, 40B, 42A and 42B. As described above, sprocket 112 is attached to one end of shaft 44.

Figure 6A:
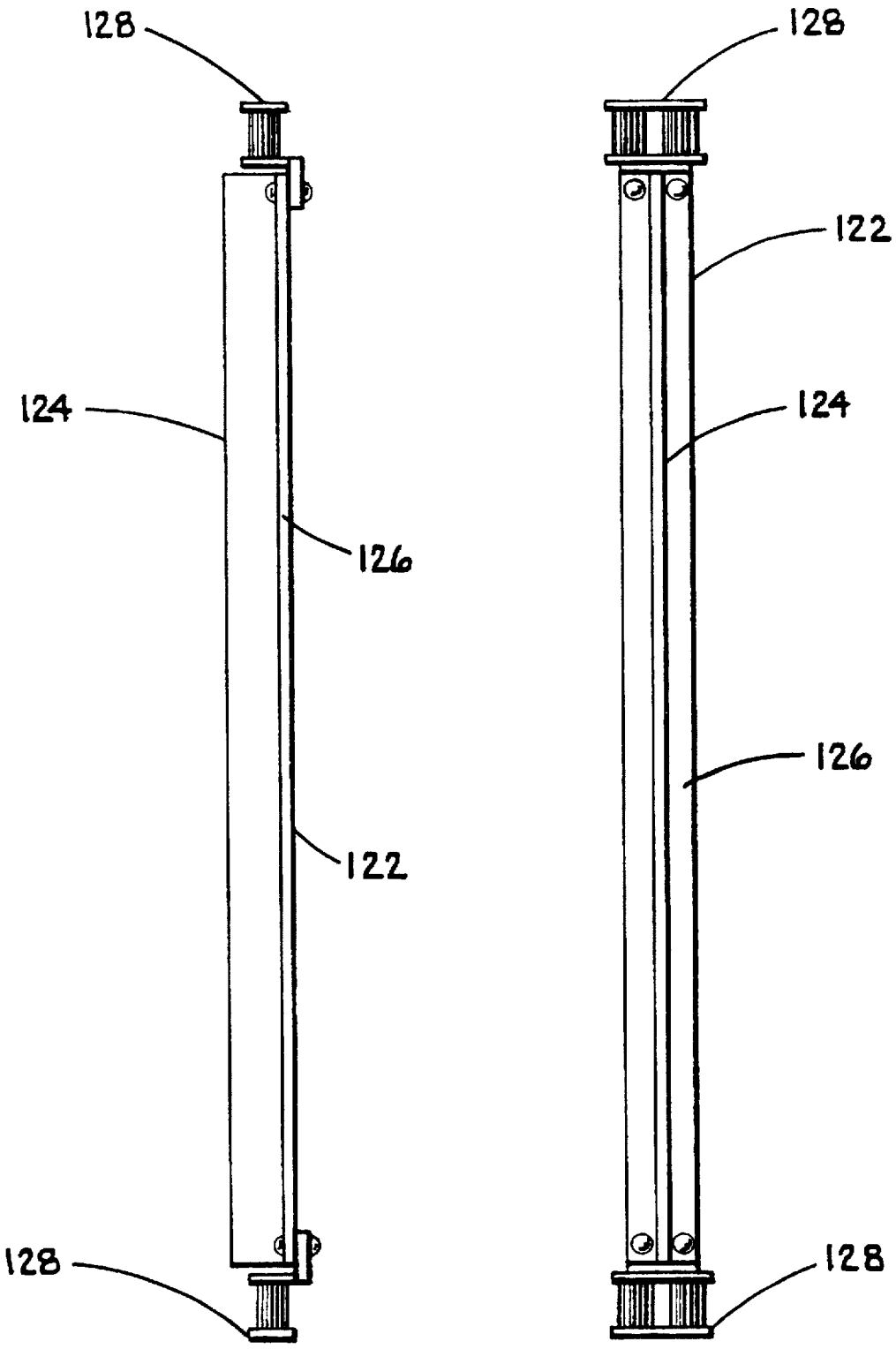
FIG. 6A is two side views of a "T-bar"

Compression conveyor 38 and support conveyor 26 provide substantial structural rigidity both across and along the surfaces facing tires placed in tire shredder 10. Both conveyors are constructed from double chain linked T-bars 122 illustrated individually in FIG. 6A in side and top views. The "T" shape of the bars provides structural rigidity while orienting the bars so that the leg 124 of the "T" faces outwardly provides for gripping tires on the conveyors. The flat 126 of the "T" provides convenient surfaces for bolting links 128 to each end of T-bars 122.

Figure 6B:
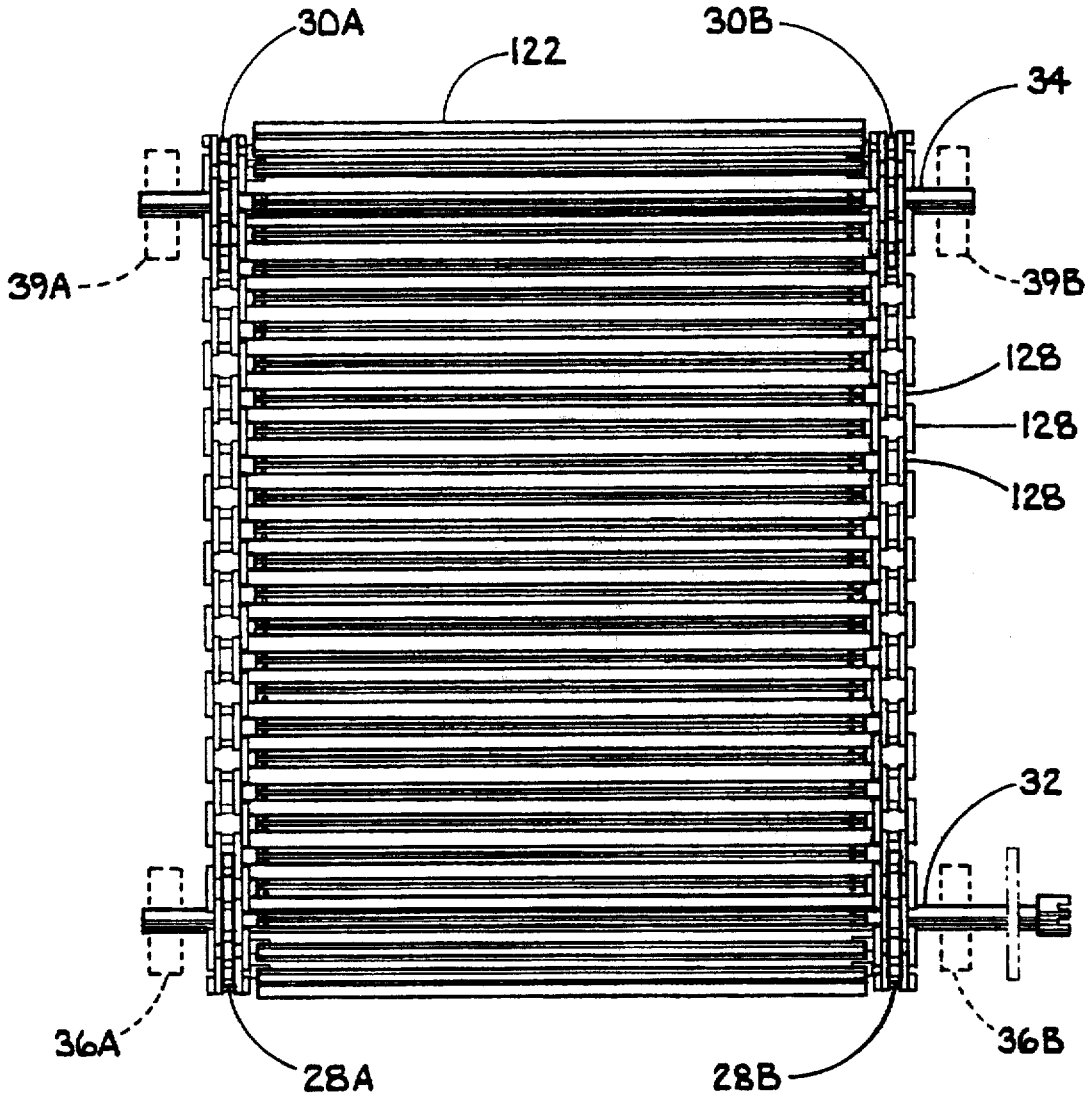
FIG. 6B is a top view of a support conveyor.

FIG. 6B is a top view of support conveyor 26 but is illustrative of the construction of either support conveyor 26 or compression conveyor 38. T-bars 122 are linked side by side in an endless chain around sprockets 28A, 28B, 30A and 30B. The width of links 128 varies to allow side by side linkage of T-bars 122.

Figure 7A:
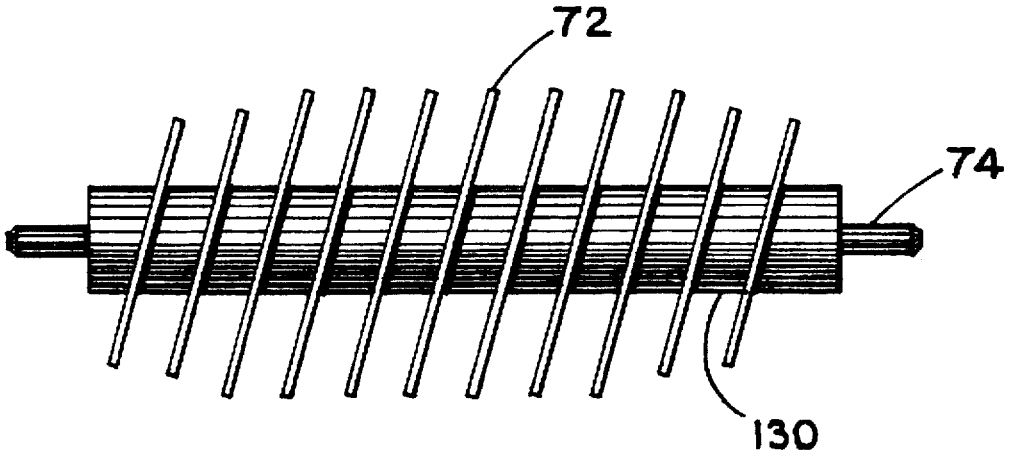
FIGS. 7A–C are side cross-sectional views of a rotary cutter.
Figure 7B:
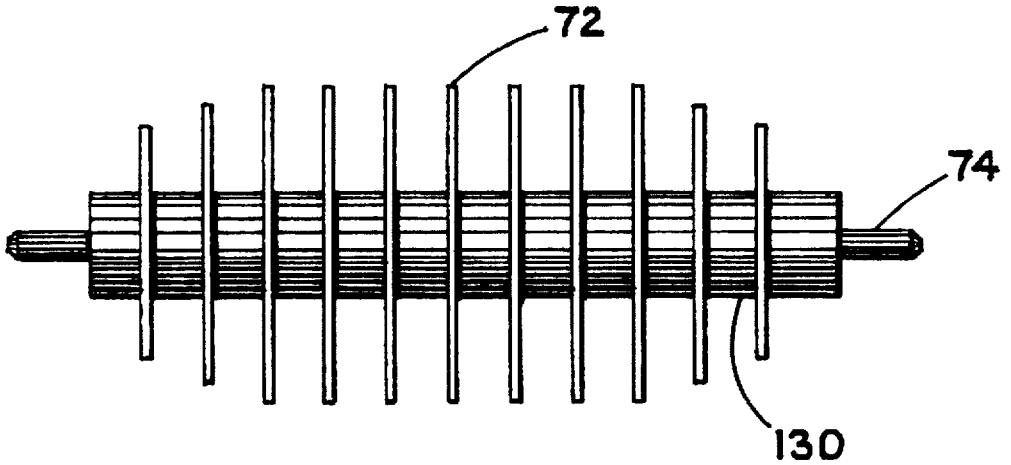
Figure 7C:
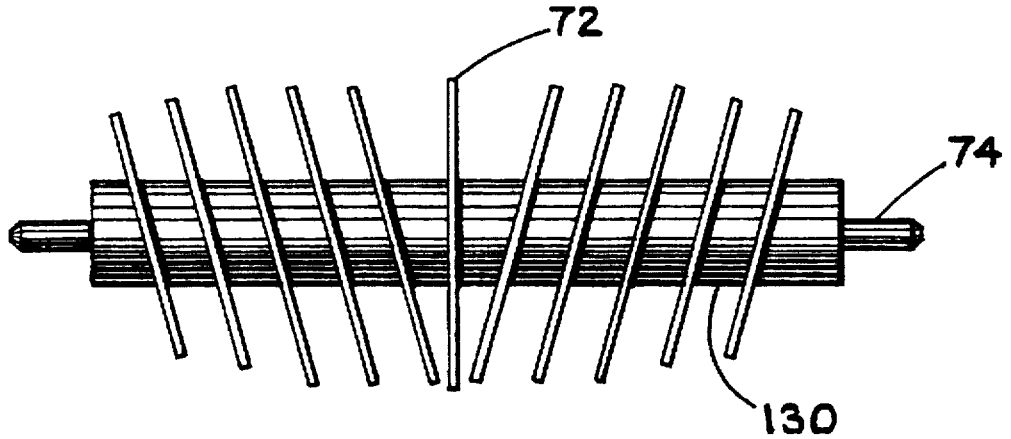

Rotary cutting assembly 14 may be implemented in any of several configurations, some of which are illustrated in FIGS. 7A–7C. Preferably, eleven circular saws 72 are spaced along shaft 74 by spacers 130. Upon removal of shaft 74 from bearing blocks 76A and 76B both spacers 130 and circular saws 72 may be removed from the shaft to allow replacement of the circular saws. Circular saws 72 are typically 9" carbide framing and ripping blades with 28 teeth. The saws mounted toward the outside of the array of saws may be of smaller diameters, for example 8" and 7", with the smallest blades positioned to the outside edge of the array. Shaft 74 uses alternate left hand and right hand threads at its opposite ends against which bolts 202 and 204 tighten when shaft 74 is turning to hold saws 72 rigidly in position on the shaft.

FIG. 7A illustrates saws 72 arranged parallel to one another and at a cant to shaft 74. This arrangement provides a wide cutting swath for each saw. In FIG. 7B saws 72 are parallel to one another and perpendicular to shaft 74. With this arrangement balancing of the saws on the shaft is not required. In FIG. 7C a center saw is perpendicular to shaft 74 with the saws to a particular side of the perpendicular saw being canted parallel to one another but oppositely to the saws on the other side of the perpendicular saw.

Figure 8:
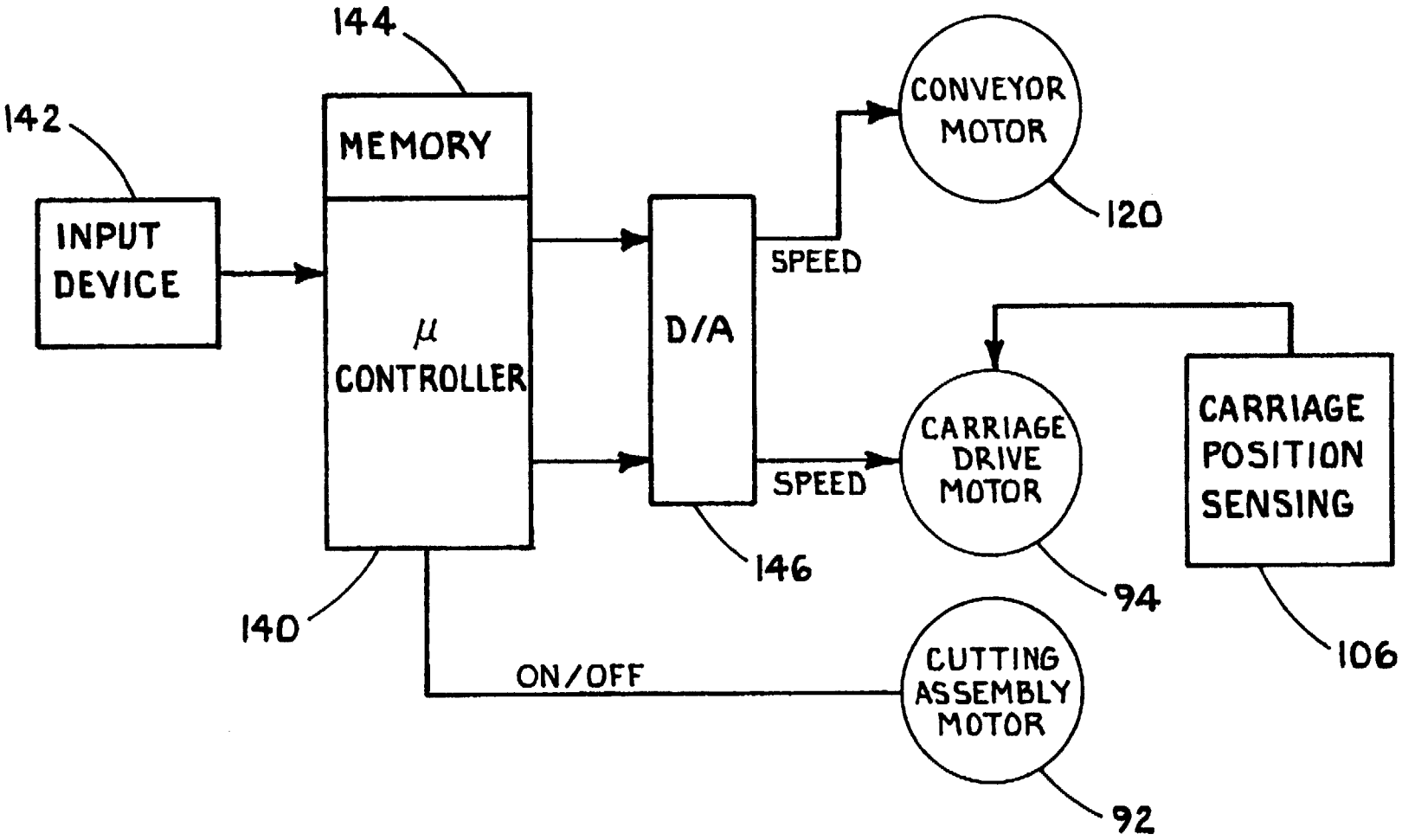
FIG. 8 is a block diagram of a control system for a tire shredder constructed in accordance with the invention.

FIG. 8 is a block diagram schematic of a control system 138 which may be used with tire shredder 10. A microcontroller 140 accepts user inputs from a keypad 142 of the dimensions of a tire being placed into tire shredder 10 to look up preset conveyor motor and carriage drive motor speeds in a look-up table stored in read only memory (ROM) in memory 144. Motor speed signals are passed from microcontroller 140 to digital to analog converter 146 to produce drive signals for conveyor motor 120 and carriage drive motor 94. An on/off signal is applied to the cutting assembly motor 92. Carriage position sensing relays 106 provide direction reversing signals to carriage drive motor 94 limiting the travel of the carriage. Motors 120 and 94 are preferably variable speed direct current motors coupled to the conveyor system 12 and carriage 78 by step down gear boxes.

The invention teaches an easily maintained, compact and simple apparatus for shredding automobile tires sufficiently for easy storage and shipping of the debris and for some recycling uses.

While the invention is shown in only one of its forms, it is not thus limited but is susceptible to various changes and modifications without departing from the spirit and scope of the invention.

What is claimed is:

1. Apparatus comprising:

a frame;

a conveyor assembly supported on the frame defining a generally linear feed path from an input end to a discharge end;

a travel positioned on the frame across the discharge end of the conveyor assembly;

a carriage disposed for reciprocating movement on the travel; and a rotary cutting assembly, mounted for rotation on the carriage at the discharge end of the conveyor assembly, the rotary cutting assembly having a shaft with an axis of rotation which is parallel to the travel, a plurality of circular blades removably mounted on the shaft, spacers separating each of the circular blades and fixing a cant for each of the circular blades with respect to the shaft, and means for driving the shaft.

2. Apparatus as claimed in claim 1, further comprising:

a carriage prime mover coupled to the carriage for reciprocation of the carriage along the travel.

3. Apparatus as claimed in claim 2, wherein the conveyor assembly includes:

a support conveyor supported on the frame;

a compression conveyor;

a suspension system depending from the frame supporting the compression conveyor in a position generally facing the compression conveyor with the support conveyor and the compression conveyor being closer at the discharge end than at the input end; and a conveyor prime mover coupled to drive synchronously the support and compression conveyors.

4. Apparatus as claimed in claim 3, wherein the travel comprises a pair of parallel linear tracks mounted on the frame and at least a first relay positioned on the frame relative to the parallel linear tracks to trigger a reversal in the direction of movement of the carriage upon movement of a predetermined distance by the carriage.

5. Apparatus as claimed in claim 4, wherein the pair of parallel linear tracks are also parallel to shafts carrying the support and compression conveyors.

6. Apparatus as claimed in claim 5, wherein the parallel tracks open at one end to allow removal of the carriage.

7. Apparatus as claimed in claim 3, wherein the suspension system further comprises:

a subframe;

a pair of shafts mounted in parallel near opposite sides of the subframe for rotation on the subframe to carry the compression conveyor;

a stabilizer bar linked to the frame and attached at opposite ends to the subframe near opposite ends of a first of the pair of shafts nearer the discharge end of the conveyor system; and at least a first support rod attached between the frame and the subframe to control spacing between the compression conveyor and the support conveyor.

8. Apparatus as claimed in claim 3, further comprising:

a controller electrically coupled to the prime movers for the conveyor system and the carriage allowing speed control signals to be transmitted to the respective prime movers; and input value generators connected to the controller for providing indication of the size of material introduced to the conveyor and allowing the controller to set values for the speed control signals.

9. Apparatus as claimed in claim 3, further comprising:

a catch pan mounted on the frame below the cutting assembly for collecting debris torn from material fed to the cutting assembly;

a discharge port from the catch pan; and a high pressure air outlet positioned near the discharge port and cooperating with the discharge port to entrain the debris in an air stream and to remove some debris through the discharge port to a collection point.

10. A tire shredder comprising:

a frame having a bottom;

a pair of parallel, vertically spaced rails mounted to the frame parallel to bottom of the frame;

a wheeled carriage mounted for travel on the pair of parallel, vertically spaced rails;

means for moving the wheeled carriage bidirectionally as selectable speeds;

a pair of opposed travel limiting relays positioned relative to the rails to be engaged by movement of the wheeled carriage;

a cutting assembly carried on the wheeled carriage including a drive motor, a drive shaft mounted with an axis of rotation parallel to the travel of the wheeled carriage, and a plurality of circular saws mounted on the drive shaft for rotation with the shaft; and a conveyer system including bottom and top conveyers wherein the top and the bottom conveyor each comprise a pair of parallel chains carrying a moving surface constructed from T-bars set across the parallel chains.

11. The tire shredder of claim 10, wherein the bottom conveyer carries tires on a feed path substantially parallel to the bottom of the frame and the top conveyor is positioned directly above the first conveyer and is spring biased to slant downwardly toward the bottom conveyor from the opening for the tires to a discharge point adjacent the cutting assembly.

12. The tire shredder of claim 11 further comprising:

a first variable speed motor connected to drive the bottom and top conveyors; and a second variable speed motor connected to move the wheeled carriage.

13. The tire shredder of claim 12, wherein the circular saws are canted with respect to the axis of rotation of the drive shaft.

14. The tire shredder of claim 12 wherein the tracks are open at one end allowing the wheeled carriage to be removed from the tracks.

15. Apparatus for shredding tires comprising:

a rotary cutting assembly having an axis of rotation;

means for conveying and uniaxially compressing tires;

a discharge from the means for conveying and uniaxially compressing;

a linear travel parallel to the axis of rotation and perpendicular to the direction of compression, positioned across the point of discharge from the means for conveying and uniaxially compressing; and means for reciprocating the rotary shredding apparatus along the linear travel.

16. The apparatus for shredding tires as set forth in claim 15, wherein the means for reciprocating the rotary shredding apparatus comprises:

a linear travel;

a wheeled carriage supported on the linear travel; and means for moving the wheeled carriage at selectable speeds.

17. The apparatus for shredding tires as set forth in claim 16, wherein the rotary cutting assembly comprises a plurality of spaced circular saws, mounted on a shaft set for rotation on the wheeled carriage.

18. The apparatus for shredding tires as set forth in claim 16, and further comprising:

means for driving the means for conveying and compressing at a selectable speed.

* * * * *